United States Patent [19]

Payne

[11] Patent Number: 4,527,658

[45] Date of Patent: Jul. 9, 1985

[54] BUBBLE SILENCER FOR AN UNDERWATER VOICE COMMUNICATOR

[76] Inventor: Philip W. Payne, 157 Cocoa Ave., Indialantic, Fla. 32903

[21] Appl. No.: 636,328

[22] Filed: Jul. 31, 1984

[51] Int. Cl.[3] ..... G10K 11/00; F01N 7/12

[52] U.S. Cl. ..... 181/235; 181/18; 181/175; 181/198; 181/252; 128/200.29

[58] Field of Search ..... 181/18, 21, 22, 173, 181/175, 235, 198, 247, 252, 127; 128/200.29, 201.19; 367/132

[56] References Cited

U.S. PATENT DOCUMENTS

| | | | |
|---|---|---|---|
| 2,485,908 | 10/1949 | Morrow | 181/235 X |
| 3,474,782 | 10/1969 | Cupp | 128/200.29 |
| 3,521,626 | 7/1970 | Hashimoto et al. | 128/201.19 |
| 3,568,672 | 3/1971 | Cupp | 128/200.29 |
| 4,183,422 | 1/1980 | Williams | 181/18 X |
| 4,467,797 | 8/1984 | Franke | 128/200.29 |

*Primary Examiner*—Benjamin R. Fuller
*Attorney, Agent, or Firm*—Jeffrey M. Ketchum

[57] ABSTRACT

A bubble silencer for use with scuba equipment is comprised of a flat flexible enclosure attached to a scuba regulator valve. Exhaust bubbles issuing from the regulator into the enclosure coalesce into large air parcels to be expelled at low velocity through a rearward exit port. The large size and low velocity of the exhaust bubbles leaving the enclosure are much quieter than the small high velocity bubbles issuing from the regulator itself.

6 Claims, 6 Drawing Figures

BUBBLE SILENCER FOR AN UNDERWATER VOICE COMMUNICATOR

BACKGROUND OF THE INVENTION

This invention relates broadly to scuba (self contained under water breathing apparatus) and more particularly to a bubble silencer to greatly minimize the obscuring noise generated by a driver's exhaust bubbles as they issue past his face. This bubble silencer was designed to be used with the tapered tube impedance matching underwater voice communicator described and claimed in my co-pending application Ser. No. 636,327, filed on even date herewith.

A major problem to the understandable perception of even quite loud underwater voice sounds is the noise of exhalation bubbles issuing from each driver's breathing regulator. That these bubbles normally pass the face, still generating some noise as they grow and coalesce, is a further disturbance to the sense of hearing of each individual diver.

DESCRIPTION OF THE PRIOR ART

The prior art attempts to reduce noise caused by exhalation bubbles have consisted of various devices that form minute bubbles from the air exhaled from an underwater breathing apparatus. Examples of these are U.S. Pat. Nos. 3,568,672, 3,521,626 and 3,474,782.

Also known in the prior art are devices of the type shown in U.S. Pat. No. 2,485,908. This patent shows a baffle type muffler of the type used on an automobile used in conjunction with diving gear.

U.S. Pat. No. 4,183,422 discloses an underwater communication device that eliminates the bubble noise problem by allowing no exhalation air to escape while the device is in use. The diver speaks into an inflated balloon and all exhausted air is trapped in the balloon until the diver removes the balloon and replaces his breathing apparatus.

SUMMARY OF THE INVENTION

It is the purpose of this disclosure to reveal a simple and effective bubble silencer to be used by a scuba diver so that any scuba diver, whether using an underwater communicator himself or not, can be freed of the proximal noise of his own bubbles and can thus hear the words of another issuing from a communicator of the type described in my above-mentioned copending application.

Before there were usable devices to inject voiced sound into the water around a diver, sound for his normal hearing perception to apprehend and understand without special hearing instruments, bubble sound contamination of the underwater environment was not a recognized problem. With the immergence of such devices, it is an obstacle to effective underwater communication.

Reduction of bubble-noise is accomplished with a muffling and isolating means of necessary novel characteristics. Experiment has shown that the primary generation of bubble-noise occurs as exhaust air is expelled from the elastic exhaust valve of the regulator. The velocity of this gas exhausted into the water is relatively high. A secondary source of noise occurs as the bubbles rise. Their immediate ascent into lesser pressure causes them to grow. Since they are already juxtaposed and compelled to jostle one another, and since they grow, they are inclined to coalesce. As they do, the gas from the two separate, somewhat round bubbles changes its total shape into one, larger, somewhat round form. This change in shape produces vibrations in the water some of which are audible as noise.

Attempts by this inventor to surround the entry and growth phases of bubbles from scuba regulators with the sound muffling shroud were at first only partially successful. Expansion of exhaust gases into such muffling devices produced constant bleeding of the scuba regulator due to a constant reduction of pressure inside the regulator diaphragm. In this invention is included an effective means of silencing the prepondurance of bubble noise from a scuba regulator exhaust without causing the runaway opening or "bleeding" of the regulator. The essence of the silencing features of this invention lies in releasing the bubbles from the regulator, not into the water but into an air jacket of flat shape but rather large interior volume. This jacket surrounds the diver's neck and remains flat except when it is passing packets of air rearwardly. Since some water inevitably intrudes into this jacket through its copious exhaust port, the jacket is constructed of foamed cell material such as used in the fabrication of diver's wetsuits. The foam cell material keeps any sound induced in the small amount of water in the jacket from reaching the water outside the jacket. Sound produced in the little water inside the jacket is not in communication directly with water outside the jacket. Instead, it is internally reflected. The issuance of gas from the regulator, whether in bubble form or not, and the coalesence of any such bubbles is allowed to occur entirely in the jacket as the air passes around either side of the diver's neck. Bubbles of large size and relative silence are released at low velocity from the large and loose exhaust port.

DETAILED DESCRIPTION

A detailed description of the underwater communicator shown in the above figures as contained in my copending application Ser. No. 636,327, filed on even date herewith. The disclosure is incorporated herein by reference.

Figure 1:
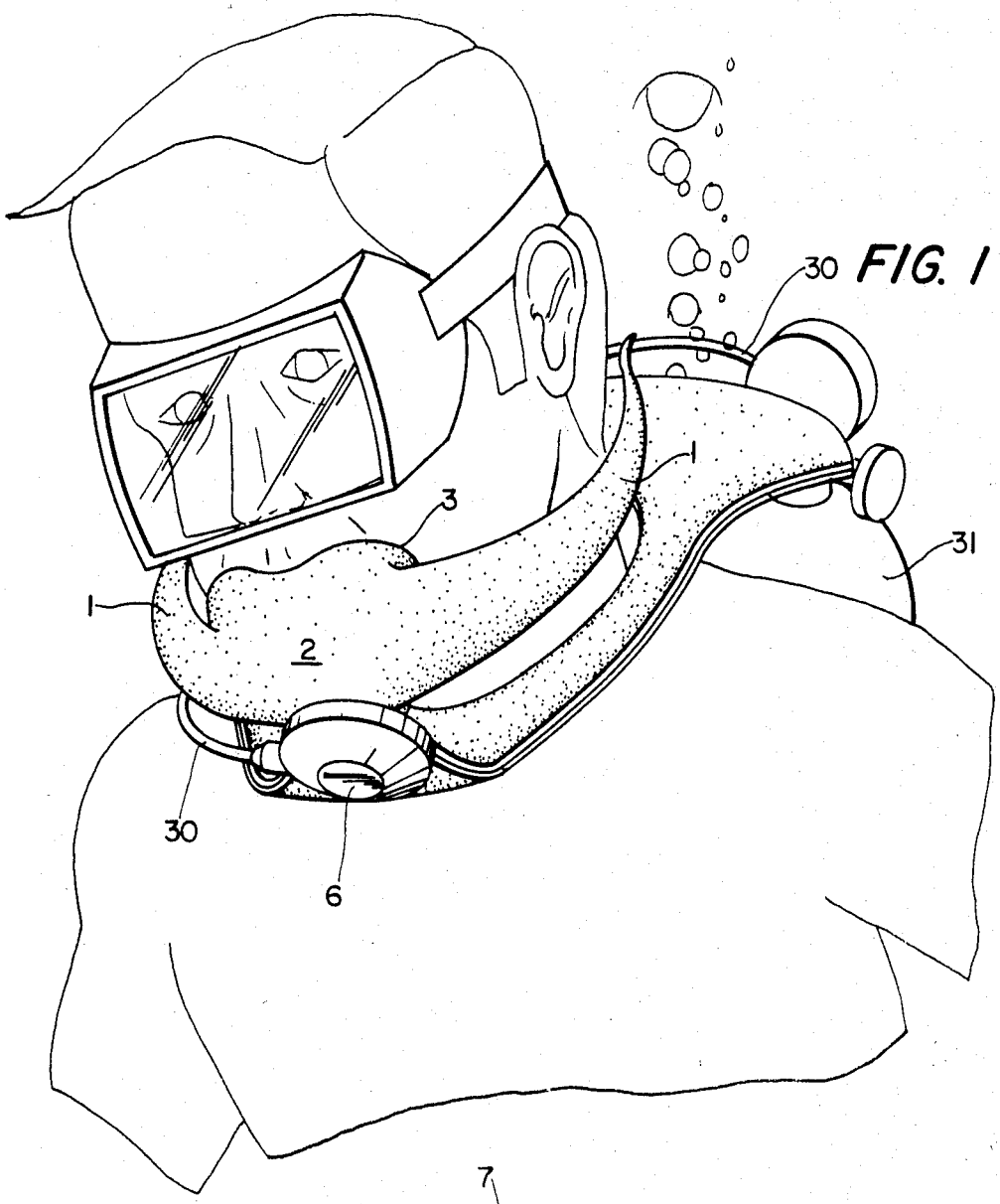
FIG. 1 is a perspective view of the preferred embodiment of the tapered tube impedance-matching underwater communicator and of the bubble-silencer as worn by a diver and as connected to a normal scuba regulator.
Figure 4:
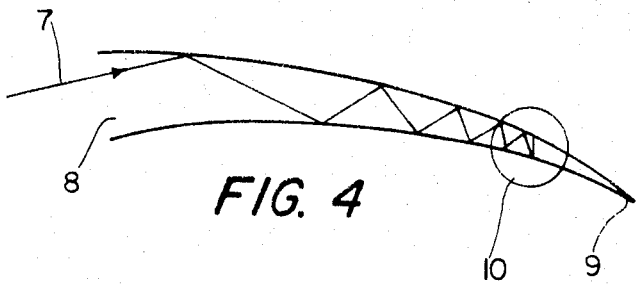
FIG. 4 is a diagram of wave reflections down a tapered tube.
Figure 3:
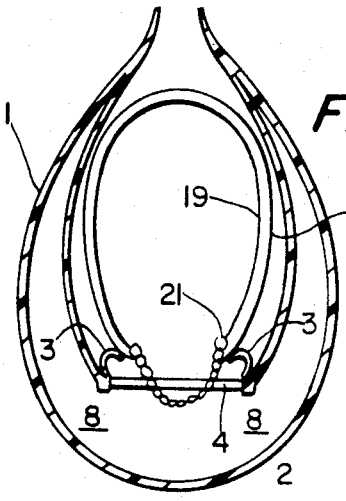
FIG. 3 is a section through a plan view of the communicator showing conformation of the inner and outer shape in relation to the flesh and skeletal outline of a diver's head.
Figure 6:
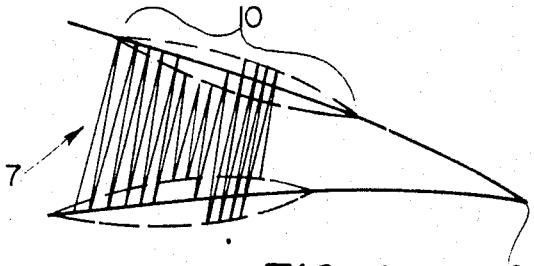
FIG. 6 is an enlarged view of the circled area of FIG. 4.
Figure 2:
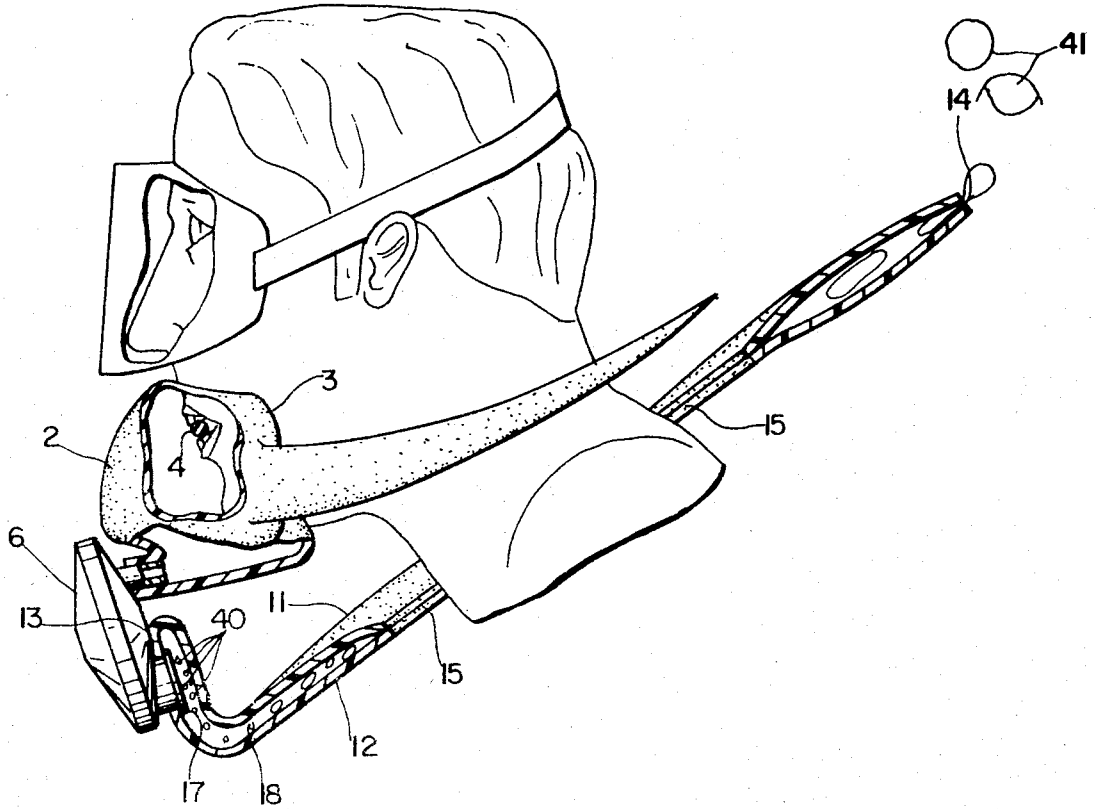
FIG. 2 is a profile view with two partial sections of said communicator and of a diver's head, showing how the bit-bar is held by the front teeth and how the communicator relates to an ordinary scuba regulator. Also in this figure said silencer is shown in the cutaway view, demonstrating how it attaches to the normal exhaust port of a scuba regulator and conducts exhausted air to an exit behind the diver's head.
Figure 5:
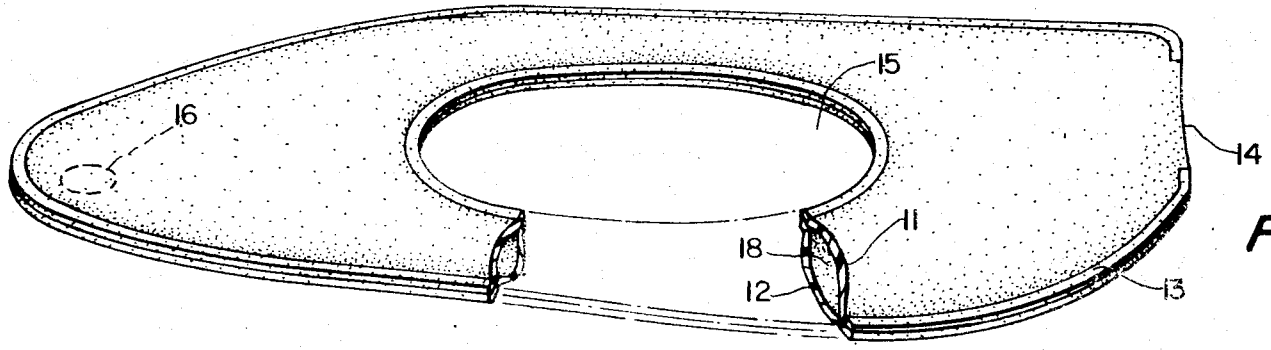
FIG. 5 is a perspective, partial sectioned view of the bubble-silencer alone.

Referring to FIGS. 2 and 5, the bubble silencer consists of two walls, top wall 11 and bottom wall 12, cemented together around their outer margin 13 except for the rearward exhaust region 14 and cemented together around the totality of their inner margins 15 which forms the aperture for slipping the silencer over the head of the diver. The two walls form an enclosure 18 for handling exhaust air from the regulator valve 17. The bottom wall 12 has a circular hole 16 near the forward edge. This hole permits the elastic material of the silencer to be stretched over and fitted around the exhaust port 17 of any modern scuba regulator 6. High velocity air bubbles 40 issued from this port, when in use in the water, enters the enclosure interior 18 rather than issuing immediately into the surrounding water. This is relatively silent. Such water sound as does occur is isolated from the surrounding water by the foam material of the top wall 11 and the bottom wall 12 of the jacket. Because of the looseness and the flat form of the jacket, the pneumatic pressure reflected back through the regulator exhaust valve 6 is the pressure ambient in the water outside the jacket just at the level of the exhaust. This results because the flat form of the silencer jacket tends naturally to flatten against the exhaust port 17 to directly transfer the ambient pressure outside the jacket to the exhaust port and thereby prevent it from bleeding. Air within the jacket is allowed to form freely into large parcels 41 before it issues from the rearward exhaust region 14 with little velocity and little further tendency to coalesce or to generate noise until it reaches the surface. Thus, the majority of the noise generated by unsilenced scuba exhaust is avoided by means of the simply manufactured embodiment.

The problem of silencing bubble noise to permit a quiet environment in which to perceive voice sounds is solved by the above-described simply manufactured, durable, and unobtrusive bubble silencer.

I claim:

1. A bubble silencer comprising:

two opposed walls of flexible material joined at their peripheries to form a flat, flexible enclosure, an inlet opening at one end of said enclosure for attachment to a scuba regulator valve to allow entrance of high velocity exhaust air bubbles of small size from said regulator valve into said enclosure, and an outlet opening opposite said inlet opening to expel said exhausted air, said flexible walls acting to coalesce said air bubbles into larger air masses and expel them at low velocity from said enclosure.

2. The bubble silencer of claim 1 wherein said enclosure has a centrally located cut out region to receive a diver's head for positioning said silencer around the diver's neck when in use, and wherein said outlet opening is located behind the diver's head when in use to exhaust said low velocity air rearwardly.

3. The bubble silencer of claim 1 wherein said silencer is constructed of water impermeable foam rubber.

4. The bubble silencer of claim 2 wherein said silencer is constructed of water impermeable foam rubber.

5. The bubble silencer of claim 1 wherein said flat, flexible enclosure acts to transfer the ambient pressure outside said enclosure to said regulator valve to prevent bleeding of said regulator valve.

6. The bubble silencer of claim 2, wherein said flat, flexible enclosure acts to transfer the ambient pressure outside said enclosure to said regulator valve to prevent bleeding of said regulator valve.

* * * * *